US005415813A

United States Patent [19]

Misselyn et al.

[11] Patent Number: 5,415,813

[45] Date of Patent: May 16, 1995

[54] LIQUID HARD SURFACE CLEANING COMPOSITION WITH GREASE RELEASE AGENT

[75] Inventors: Anne M. Misselyn, Villers-l'Eveque; Marianne Mahieu, Ferrieres; Georges Yianakopoulos, Liege; Rita Erilli, Rocourt; all of Belgium

[73] Assignee: Colgate-Palmolive Company, Piscataway, N.J.

[21] Appl. No.: 155,262

[22] Filed: Nov. 22, 1993

[51] Int. Cl.[6] ..... C11D 3/30; C11D 3/43; C11D 3/44; C11D 1/62

[52] U.S. Cl. ..... 252/547; 252/548; 252/153; 252/173; 252/357; 252/527; 252/528; 252/DIG. 3; 252/DIG. 1; 252/DIG. 14; 252/DIG. 15; 252/DIG. 17

[58] Field of Search ..... 252/153, 527, 528, 547, 252/548, 173, 174.24, DIG. 1, DIG. 15, DIG. 17, DIG. 14, 356, 357, 529, DIG. 3; 106/2

[56] References Cited

U.S. PATENT DOCUMENTS

| | | | |
|---|---|---|---|
| 3,294,726 | 12/1966 | Wyner | 252/DIG. 2 |
| 4,199,464 | 4/1980 | Cambre | 252/548 X |
| 4,353,745 | 10/1982 | Ebbeler | 252/548 X |
| 4,472,291 | 9/1984 | Rosano | 252/DIG. 13 |
| 4,501,680 | 2/1985 | Aszman et al. | 252/DIG. 14 |
| 4,540,448 | 10/1985 | Gautier et al. | 252/DIG. 14 |
| 4,589,988 | 5/1986 | Rieck et al. | 252/135 X |
| 5,008,030 | 4/1991 | Cook et al. | 252/DIG. 14 |
| 5,082,584 | 1/1992 | Loth et al. | 252/171 X |
| 5,108,643 | 4/1992 | Loth et al. | 252/171 X |
| 5,223,179 | 6/1993 | Connor et al. | 252/548 |

OTHER PUBLICATIONS

CA 115:250369, JP 3,063,202 (Mar. 19, 1991).

*Primary Examiner*—Paul Lieberman
*Assistant Examiner*—Douglas J. McGinty
*Attorney, Agent, or Firm*—Richard E. Nanfeldt; Robert C. Sullivan; Murray Grill

[57] ABSTRACT

An improvement is described in microemulsion compositions which contain an anionic detergent, a nonionic surfactant, a grease release agent, a hydrocarbon ingredient, and water which comprises the use of a water-insoluble odoriferous perfume as the essential hydrocarbon ingredient in a proportion sufficient to form either a dilute o/w microemulsion composition containing, by weight, 1% to 20% of an anionic detergent, 6 to 50% of a cosurfactant, 1% to 10% of a grease release agent, 0.4% to 10% of perfume and the balance being water as well as all purpose hard surface cleaning composition or light duty liquid detergent compositions which contain a grease release agent.

22 Claims, No Drawings

LIQUID HARD SURFACE CLEANING COMPOSITION WITH GREASE RELEASE AGENT

This invention relates to an improved all-purpose liquid cleaner in the form of a microemulsion designed in particular for cleaning hard surfaces and which is effective in removing grease soil and/or bath soil and in leaving unrinsed surfaces with a shiny appearance as well as to an all purpose hard surface cleaner or light duty liquid detergent composition which contains a grease release agent and these compositions are effective in removing grease soil.

BACKGROUND OF THE INVENTION

In recent years all-purpose liquid detergents have become widely accepted for cleaning hard surfaces, e.g., painted woodwork and panels, tiled walls, wash bowls, bathtubs, linoleum or tile floors, washable wall paper, etc. Such all-purpose liquids comprise clear and opaque aqueous mixtures of water-soluble synthetic organic detergents and water-soluble detergent builder salts. In order to achieve comparable cleaning efficiency with granular or powdered all-purpose cleaning compositions, use of water-soluble inorganic phosphate builder salts was favored in the prior art all-purpose liquids. For example, such early phosphate-containing compositions are described in U.S. Pat. Nos. 2,560,839; 3,234,138; 3,350,319; and British Patent No. 1,223,739.

In view of the environmentalist's efforts to reduce phosphate levels in ground water, improved all-purpose liquids containing reduced concentrations of inorganic phosphate builder salts or non-phosphate builder salts have appeared. A particularly useful self-opacified liquid of the latter type is described in U.S. Pat. No. 4,244,840.

However, these prior art all-purpose liquid detergents containing detergent builder salts or other equivalent tend to leave films, spots or streaks on cleaned unrinsed surfaces, particularly shiny surfaces. Thus, such liquids require thorough rinsing of the cleaned surfaces which is a time-consuming chore for the user.

In order to overcome the foregoing disadvantage of the prior art all-purpose liquid, U.S. Pat. No. 4,017,409 teaches that a mixture of paraffin sulfonate and a reduced concentration of inorganic phosphate builder salt should be employed. However, such compositions are not completely acceptable from an environmental point of view based upon the phosphate content. On the other hand, another alternative to achieving phosphate-free all-purpose liquids has been to use a major proportion of a mixture of anionic and nonionic detergents with minor amounts of glycol ether solvent and organic amine as shown in U.S. Pat. No. 3,935,130. Again, this approach has not been completely satisfactory and the high levels of organic detergents necessary to achieve cleaning cause foaming which, in turn, leads to the need for thorough rinsing which has been found to be undesirable to today's consumers.

Another approach to formulating hard surface or all-purpose liquid detergent composition where product homogeneity and clarity are important considerations involves the formation of oil-in-water (o/w) microemulsions which contain one or more surface-active detergent compounds, a water-immiscible solvent (typically a hydrocarbon solvent), water and a "cosurfactant" compound which provides product stability. By definition, an o/w microemulsion is a spontaneously forming colloidal dispersion of "oil" phase particles having a particle size in the range of about 25 to about 800 Å in a continuous aqueous phase. In view of the extremely fine particle size of the dispersed oil phase particles, microemulsions are transparent to light and are clear and usually highly stable against phase separation.

Patent disclosures relating to use of grease-removal solvents in o/w microemulsions include, for example, European Patent Applications EP 0137615 and EP 0137616—Herbots et al; European Patent Application EP 0160762—Johnston et al; and U.S. Pat. No. 4,561,991—Herbots et al. Each of these patent disclosures also teaches using at least 5% by weight of grease-removal solvent.

It also is known from British Patent Application GB 2144763A to Herbots et al, published Mar. 13, 1985, that magnesium salts enhance grease-removal performance of organic grease-removal solvents, such as the terpenes, in o/w microemulsion liquid detergent compositions. The compositions of this invention described by Herbots et al. require at least 5% of the mixture of grease-removal solvent and magnesium salt and preferably at least 5% of solvent (which may be a mixture of water-immiscible non-polar solvent with a sparingly soluble slightly polar solvent) and at least 0.1% magnesium salt.

However, since the amount of water immiscible and sparingly soluble components which can be present in an o/w microemulsion, with low total active ingredients without impairing the stability of the microemulsion is rather limited (for example, up to about 18% by weight of the aqueous phase), the presence of such high quantities of grease-removal solvent tend to reduce the total amount of greasy or oily soils which can be taken up by and into the microemulsion without causing phase separation. The following representative prior art patents also relate to liquid detergent cleaning compositions in the form of o/w microemulsions: U.S. Pat. Nos. 4,472,291—Rosario; 4,540,448—Gauteer et al; 3,723,330—Sheflin; etc.

Liquid detergent compositions which include terpenes, such as d-limonene, or other grease-removal solvent, although not disclosed to be in the form of o/w microemulsions, are the subject matter of the following representative patent documents: European Patent Application 0080749; British Patent Specification 1,603,047; 4,414,128; and 4,540,505. For example, U.S. Pat. No. 4,414,128 broadly discloses an aqueous liquid detergent composition characterized by, by weight:

(a) from about 1% to about 20% of a synthetic anionic, nonionic, amphoteric or zwitterionic surfactant or mixture thereof;

(b) from about 0.5% to about 10% of a mono- or sesquiterpene or mixture thereof, at a weight ratio of (a):(b) being in the range of 5:1 to 1:3; and (c) from about 0.5% about 10% of a polar solvent having a solubility in water at 15° C. in the range of from about 0.2% to about 10%. Other ingredients present in the formulations disclosed in this patent include from about 0.05% to about 2% by weight of an alkali metal, ammonium or alkanolammonium soap of a $C_{13}$–$C_{24}$ fatty acid; a calcium sequestrant from about 0.5% to about 13% by weight; non-aqueous solvent, e.g., alcohols and glycol ethers, up to about 10% by weight; and hydrotropes, e.g., urea, ethanolamines, salts of lower alkylaryl sulfonates, up to about 10% by weight. All of the formulations shown in the Examples of this patent include relatively large amounts of detergent builder salts which are detrimental to surface shine.

Furthermore, the present invention teaches that in formulations containing grease-removal assisting magnesium compounds, the addition of minor amounts of builder salts, such as alkali metal polyphosphates, alkali metal carbonates, nitrilotriacetic acid salts, and so on, tends to make it more difficult to form stable microemulsion systems as well as causing residual deposits on the surface being cleaned, if they are incorporated into a light duty liquid detergent compositions.

U.S. Pat. No. 5,082,584 discloses a microemulsion composition having an anionic surfactant, a cosurfactant, nonionic surfactant, perfume and water; however, these compositions do not possess the grease release effect.

A major problem in cleaning of hard surface is the build up of grease on the hard surface. It is desirably in the cleaning of hard surface to be able to minimize this grease build up. The unique and novel microemulsion, all purpose hard surface cleaners and light duty liquid detergent compositions of the instant invention have incorporated therein a grease release agent which helps minimize the build up of grease on the surface being cleaned.

SUMMARY OF THE INVENTION

The present invention provides improved, clear, liquid cleaning compositions having improved interfacial tension which improves cleaning hard surface in the form of a microemulsion or in a non microemulsion compositions. These compositions are suitable for cleaning hard surfaces such as plastic, vitreous and metal surfaces having a shiny finish or in the form of an all purpose hard surface cleaner or a light duty liquid detergent.

More particularly, the improved cleaning compositions exhibit good grease soil removal properties due to the improved interfacial tensions, when used in undiluted (neat) form and leave the cleaned surfaces shiny without the need of or requiring only minimal additional rinsing or wiping. The latter characteristic is evidenced by little or no visible residues on the unrinsed cleaned surfaces and, accordingly, overcomes one of the disadvantages of prior art products. The instant microemulsion or non microemulsion composition or light duty liquid detergent composition exhibit a grease release effect in that the instant composition impedes or decreases the anchoring of greasy soil on surfaces that have been cleaned with the instant composition as compared to surfaces cleaned with a commercial microemulsion composition which means that the grease soiled surface is easier to clean upon subsequent cleanings. Surprisingly, these desirable results are accomplished even in the absence of polyphosphate or other inorganic or organic detergent builder salts and also in the complete absence or substantially complete absence of grease-removal solvent.

In one aspect, the invention generally provides a stable, clear all-purpose, hard surface cleaning composition especially effective in the removal of oily and greasy oil, which is in the form of a substantially dilute oil-in-water microemulsion having an aqueous phase and an oil phase; The dilute o/w microemulsion includes, on a weight basis:

from about 0.1% to 20% by weight of an anionic surfactant;

from about 0.1% to 10% by weight of a non-ionic surfactant;

from 0.1% to about 50% of a water-mixable cosurfactant having either limited ability or substantially no ability to dissolve oily or greasy soil;

from about 1% to about 10% of a grease release agent;

0 to 15% of magnesium sulfate heptahydrate;

0.4 to 10.0% of a perfume or water insoluble hydrocarbon; and 10 to 85% of water, said proportions being based upon the total weight of the composition. Quite surprisingly although the perfume is not, per se, a solvent for greasy or oily soil,—even though some perfumes may, in fact, contain as much as about 80% of terpenes which are known as good grease solvents—the inventive compositions in dilute form have the capacity to solubilize up to about 10 times or more of the weight of the perfume of oily and greasy soil, which is removed or loosened from the hard surface by virtue of the action of the anionic surfactant, said soil being taken up into the oil phase of the o/w microemulsion.

In second aspect, the invention generally provides highly concentration microemulsion compositions in the form of either an oil-in-water (o/w) microemulsion or a water-in-oil (w/o) microemulsion which when diluted with additional water before use can form dilute o/w microemulsion compositions. Broadly, the concentrated microemulsion compositions contain, by weight, 0.1% to 20% of an anionic surfactant, 0.1% to 20% of a non-ionic surfactant, 0.1% to 50% of a cosurfactant, 0.1% to 5% of $MgSO_4.7H_2O$ 1% to 10% of a grease release agent, 0.4% to 10% of perfume or water insoluble hydrocarbon having about 6 to 18 carbon atoms, 0.1% to 50% of a cosurfactant, and 20% to 97% of water.

The invention also relates to light duty liquid detergent compositions having improved grease properties which comprises approximately by weight:

(a) 1 to 50 wt. % of at least one surfactant, wherein the surfactant is selected from the group consisting of fatty acid soap surfactants, nonionic surfactants, anionic surfactants, zwitterionic surfactants and alkyl polysaccharides surfactants and mixtures thereof;

(b) 0.1 to 10 wt. % of a grease release agent;

(c) 0 to 15 wt. % of a solubilizing agent; and (d) the balance being water.

This invention also relates to an all purpose hard surface cleaner composition which comprises approximately by weight:

(a) 1 to 30% of at least one surfactant selected from the group consisting of nonionic surfactants and anionic surfactants and mixtures thereof;

(b) 1 to 15% of a cosurfactant;

(c) 0.1 to 5% of a magnesium containing inorganic compound;

(d) 0.05 to 0.3% of a perfume;

(e) 0.1 to 10% of a grease release agent; and (f) the balance being water.

DETAILED DESCRIPTION OF THE INVENTION

The present invention relates to a stable microemulsion composition approximately by weight: 0.1% to 20% of an anionic surfactant, 0.1% to 50% of a cosurfactant, 0.1% to 20% of a non-ionic surfactant, 0.1% to 5% of $MgSO_4.7H_2O$; 0.1% to 10% of a grease release agent; 0.1% to 10% of a water insoluble hydrocarbon or a perfume and the balance being water.

The detergent compositions of the present invention can be in the form of an oil-in-water microemulsion in the first aspect or after dilution with water in the second aspect, with the essential ingredients being water, anionic/nonionic surfactant, cosurfactant, grease release agent, and a hydrocarbon or perfume.

According to the present invention, the role of the hydrocarbon is provided by a non-water-soluble perfume. Typically, in aqueous based compositions the presence of a solubilizers, such as alkali metal lower alkyl aryl sulfonate hydrotrope, triethanolamine, urea, etc., is required for perfume dissolution, especially at perfume levels of about 1% and higher, since perfumes are generally a mixture of fragrant essential oils and aromatic compounds which are generally not water-soluble. Therefore, by incorporating the perfume into the aqueous cleaning composition as the oil (hydrocarbon) phase of the ultimate o/w microemulsion composition, several different important advantages are achieved.

First, the cosmetic properties of the ultimate cleaning composition are improved: the compositions are both clear as a consequence of the formation of a microemulsion and highly fragranced as a consequence of the perfume level.

Second, an improved grease release effect and an improved grease removal capacity in neat (undiluted) usage of the dilute aspect or after dilution of the concentrate can be obtained without detergent builders or buffers or conventional grease removal solvents at neutral or acidic pH and at low levels of active ingredients while improved cleaning performance can also be achieved in diluted usage.

As used herein and in the appended claims the term "perfume" is used in its ordinary sense to refer to and include any non-water soluble fragrant substance or mixture of substances including natural (i.e., obtained by extraction of flower, herb, blossom or plant), artificial (i.e., mixture of natural oils or oil constituents) and synthetically produced substance) odoriferous substances. Typically, perfumes are complex mixtures of blends of various organic compounds such as alcohols, aldehydes, ethers, aromatic compounds and varying amounts of essential oils (e.g., terpenes) such as from about 0% to about 80%, usually from about 10% to 70% by weight, the essential oils themselves being volatile odoriferous compounds and also serving to dissolve the other components of the perfume.

In the present invention the precise composition of the perfume is of no particular consequence to cleaning performance so long as it meets the criteria of water immiscibility and having a pleasing odor. Naturally, of course, especially for cleaning compositions intended for use in the home, the perfume, as well as all other ingredients, should be cosmetically acceptable, i.e., non-toxic, hypoallergenic, etc.

The hydrocarbon such as a perfume is present in the dilute o/w microemulsion in an amount of from about 0.4% to about 10% by weight, preferably from about 0.1% to about 3.0% by weight, especially preferably from about 0.5% to about 2.0% by weight, such as about weight percent. If the amount of hydrocarbon (perfume) is less than about 0.4% by weight it becomes difficult to form the o/w microemulsion. If the hydrocarbon (perfume) is added in amounts more than about 10% by weight, the cost is increased without any additional cleaning benefit and, in fact, with some diminishing of cleaning performance insofar as the total amount of greasy or oily soil which can be taken up in the oil phase of the microemulsion will decrease proportionately.

Furthermore, although superior grease removal performance will be achieved for perfume compositions not containing any terpene solvents, it is apparently difficult for perfumers to formulate sufficiently inexpensive perfume compositions for products of this type (i.e., very cost sensitive consumer-type products) which includes less than about 20%, usually less than about 30%, of such terpene solvents.

Thus, merely as a practical matter, based on economic consideration, the dilute o/w microemulsion detergent cleaning compositions of the present invention may often include as much as about 0.2% to about 7% by weight, based on the total composition, of terpene solvents introduced thereunto via the perfume component. However, even when the amount of terpene solvent in the cleaning formulation is less than 1.5% by weight, such as up to about 0.6% by weight or 0.4% by weight or less, satisfactory grease removal and oil removal capacity is provided by the inventive diluted o/w microemulsions.

Thus, for a typical formulation of a diluted o/w microemulsion according to this invention a 20 milliliter sample of o/w microemulsion containing about 1% by weight of perfume will be able to solubilize, for example, up to about 2 to 3 ml of greasy and/or oily soil, while retaining its form as a microemulsion, regardless of whether the perfume contains 0%, 0.1%, 0.2%, 0.3%, 0.4%, 0.5%, 0.6%, 0.7% or 0.8% by weight of terpene solvent. In other words, it is an essential feature of the compositions of this invention that grease removal is a function of the result of the microemulsion, per se, and not of the presence or absence in the microemulsion of a "greasy soil removal" type of solvent.

In place of the perfume one can employ a water insoluble paraffin or isoparaffin having about 6 to about 18 carbon at a concentration of about 0.4 to about 8.0 wt. percent, more preferably 0.4 to 3.0 wt. %.

Regarding the anionic detergent present in the o/w microemulsions any of the conventionally used water-soluble anionic detergents can be used in this invention. As used herein the term "anionic surfactant" is intended to refer to the class of anionic and mixed anionic-nonionic detergents providing detersive action.

Suitable water-soluble non-soap, anionic detergents used in the instant compositions include those surface-active or detergent compounds which contain an organic hydrophobic group containing generally 8 to 26 carbon atoms and preferably 10 to 18 carbon atoms in their molecular structure and at least one water-solubilizing group selected from the group of sulfonate, sulfate and carboxylate so as to form a water-soluble detergent. Usually, the hydrophobic group will include or comprise a $C_8$–$C_{22}$ alkyl, alkyl or acyl group. Such detergents are employed in the form of water-soluble salts and the salt-forming cation usually is selected from the group consisting of sodium, potassium, ammonium, magnesium and mono-, di- or tri-$C_2$–$C_3$ alkanolammonium, with the sodium, magnesium and ammonium cations again being preferred.

Examples of suitable sulfonated anionic detergents are the well known higher alkyl mononuclear aromatic sulfonates such as the higher alkyl benzene sulfonates containing from 10 to 16 carbon atoms in the higher alkyl group in a straight or branched chain, $C_8$–$C_{15}$ alkyl toluene sulfonates and $C_8$–$C_{15}$ alkyl phenol sulfonates.

A preferred sulfonate is linear alkyl benzene sulfonate having a high content of 3- (or higher) phenyl isomers and a correspondingly low content (well below 50%) of 2- (or lower) phenyl isomers, that is, wherein the benzene ring is preferably attached in large part at the 3 or higher (for example, 4, 5, 6 or 7) position of the alkyl group and the content of the isomers in which the benzene ring is attached in the 2 or 1 position is correspondingly low. Particularly preferred materials are set forth in U.S. Pat. No. 3,320,174.

Other suitable anionic detergents are the olefin sulfonates, including long-chain alkene sulfonates, long-chain hydroxyalkane sulfonates or mixtures of alkene sulfonates and hydroxyalkane sulfonates. These olefin sulfonate detergents may be prepared in a known manner by the reaction of sulfur trioxide ($SO_3$) with long-chain olefins containing 8 to 25, preferably 12 to 21 carbon atoms and having the formula $RCH{=}CHR_1$ where R is a higher alkyl group of 6 to 23 carbons and $R_1$ is an alkyl group of 1 to 17 carbons or hydrogen to form a mixture of sultones and alkene sulfonic acids which is then treated to convert the sultones to sulfonates. Preferred olefin sulfonates contain from 14 to 16 carbon atoms in the R alkyl group and are obtained by sulfonating an 2 olefin.

Other examples of suitable anionic sulfonate detergents are the paraffin sulfonates containing about 10 to 20, preferably about 13 to 17, carbon atoms. Primary paraffin sulfonates are made by reacting long-chain alpha olefins and bisulfites and paraffin sulfonates having the sulfonate group distributed along the paraffin chain are shown in U.S. Pat. Nos. 2,503,280; 2,507,088; 3,260,744; 3,372,188; and German Patent 735,096.

Examples of satisfactory anionic sulfate detergents are the $C_8$–$C_{18}$ alkyl sulfate salts and the $C_8$–$C_{18}$ alkyl ether polyethenoxy sulfate salts having the formula $R(OC_2H_4)_nOSO_3M$ wherein n is 1 to 12, preferably 1 to 5, and M is a solubilizing cation selected from the group consisting of sodium, potassium, ammonium, magnesium and mono-, di- and triethanol ammonium ions. The alkyl sulfates may be obtained by sulfating the alcohols obtained by reducing glycerides of coconut oil or tallow or mixtures thereof and neutralizing the resultant product. On the other hand, the alkyl ether polyethenoxy sulfates are obtained by sulfating the condensation product of ethylene oxide with a $C_8$–$C_{18}$ alkanol and neutralizing the resultant product. The alkyl sulfates may be obtained by sulfating the alcohols obtained by reducing glycerides of coconut oil or tallow or mixtures thereof and neutralizing the resultant product. On the other hand, the alkyl ether polyethenoxy sulfates are obtained by sulfating the condensation product of ethylene oxide with a $C_8$–$C_{18}$ alkanol and neutralizing the resultant product. The alkyl ether polyethenoxy sulfates differ from one another in the number of moles of ethylene oxide reacted with one mole of alkanol. Preferred alkyl sulfates and preferred alkyl ether polyethenoxy sulfates contain 10 to 16 carbon atoms in the alkyl group.

The $C_8$–$C_{12}$ alkylphenyl ether polyethenoxy sulfates containing from 2 to 6 moles of ethylene oxide in the molecule also are suitable for use in the inventive compositions. These detergents can be prepared by reacting an alkyl phenol with 2 to 6 moles of ethylene oxide and sulfating and neutralizing the resultant ethoxylated alkylphenol.

Other suitable anionic detergents are the $C_9$–$C_{15}$ alkyl ether polyethenoxy carboxylates having the structural formula $R(OC_2H_4)_nOX$ COOH where n is a number from 4 to 12, preferably 5 to 10 and X is selected from the group consisting of $CH_2$, $C(O)R_1$ and C(O)

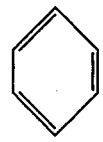

wherein $R_1$ is a $C_1$–$C_3$ alkylene group. Prefered compounds include $C_9$–$C_{11}$ alkyl ether polyethenoxy (7–9) $C(O)CH_2CH_2COOH$, $C_{13}$–$C_{15}$ alkyl ether polyethenoxy (7–9) C(O)

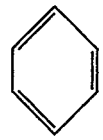

COOH and $C_{10}$–$C_{12}$ alkyl ether polyethenoxy (5–7) $CH_2COOH$. These compounds may be prepared by condensing ethylene oxide with the appropriate alkanol and reacting this reaction product with chloracetic acid to make the ether carboxylic acids as shown in U.S. Pat. No. 3,741,911 or with succinic anhydride or phthalic anhydride. Obviously, these anionic detergents will be present either in acid form or salt form depending upon the pH of the final composition, with salt forming cation being the same as for the other anionic detergents.

Of the foregoing non-soap anionic detergents, the preferred detergents are the $C_9$–$C_{15}$ linear alkylbenzene sulfonates and the $C_{13}$–$C_{17}$ paraffin or alkane sulfonates. Particularly, preferred compounds are sodium $C_{10}$–$C_{13}$ alkylbenzene sulfonate and sodium $C_{13}$–$C_{17}$ alkane sulfonate.

Generally, the proportion of the nonsoap-anionic detergent will be in the range of 0.1% to 20.0%, preferably from 1% to 7%, by weight of the dilute o/w microemulsion composition.

The grease release agents of the instant invention are characterized by the formula:

$$\left[ R_1-\overset{\overset{R_2}{|}}{\underset{\underset{R_3}{|}}{N^+}}-R_4 \right] X^-$$

wherein $R_1$ is a methyl group and $R_2$, $R_3$ and $R_4$ are independently selected from the group consisting of methyl, ethyl,and $CH_2CH_2Y$, wherein Y is selected from the group consisting of Cl, Br, $CO_2H$, $(CH_2O)n$ OH wherein n=1 to 10, OH, $CH_2CH_9OH$ and x is selected from the group consisting of Cl, Br, methosulfate

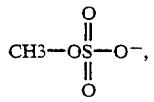

and $HCO_3^-$. Preferred grease release agents are B-hydroxyethyltrimethyl ammonium chloride (choline chloride), B-chloroethyltrimethyl ammonium chloride, and tri(B-hydroxyethyl) methyl ammonium methosulfate (Stepanquat T), wherein the choline chloride is preferred. It is theorized that the positively charged grease release agent is electrostatically bonded to the negatively charged groups on the surface of the surface to be cleaned such as a ceramic thereby preventing bonding of calcium ions contained in grease to the negative charged surface of the ceramic tile. The concentration of the grease release agent in the instant microemulsion composition is about 0.1 to about 10 wt. % and more preferably about 1.0 to about 8.0 wt. %.

The cosurfactant may play an essential role in the formation of the dilute o/w microemulsion and the concentrated microemulsion compositions. Very briefly, in the absence of the cosurfactant the water, detergent(s) and hydrocarbon (e.g., perfume) will, when mixed in appropriate proportions form either a micellar solution (low concentration) or form an oil-in-water emulsion in the first aspect of the invention. With the cosurfactant added to this system, the interfacial tension at the interface between the emulsion droplets and aqueous phase is reduced to a very low value (never negative). This reduction of the interfacial tension results in spontaneous break-up of the emulsion droplets to consecutively smaller aggregates until the state of a transparent colloidal sized emulsion. e.g., a microemulsion, is formed. In the state of a microemulsion, thermodynamic factors come into balance with varying degrees of stability related to the total free energy of the microemulsion. Some of the thermodynamic factors involved in determining the total free energy of the system are (1) particle-particle potential; (2) interfacial tension or free energy (stretching and bending); (3) droplet dispersion entropy; and (4) chemical potential changes upon formation. A thermodynamically stable system is achieved when (2) interfacial tension or free energy is minimized and (3) droplet dispersion entropy is maximized. Thus, the role of cosurfactant in formation of a stable o/w microemulsion is to (a) decrease interfacial tension (2); and (b) modify the microemulsion structure and increase the number of possible configurations (3). Also, the cosurfactant will (c) decrease the rigidity of the interfacial film.

Four major classes of compounds have been found to provide highly suitable cosurfactants over temperature ranges extending from 5° C. to 43° C. for instance; (1) water-soluble $C_3$–$C_4$ alkanols, polypropylene glycol of the formula $HO(CH_3CHCH_2O)_nH$ wherein n is a number from 2 to 18 and monoalkyl ethers and esters of ethylene glycol and propylene glycol having the structural formulas $R(X)_nOH$ and $R_1(X)_nOH$ wherein R is $C_1$–$C_6$ alkyl, $R_1$ is $C_2$–$C_4$ acyl group, X is $(OCH_2CH_2)$ or $(OCH_3CHCH_2)$ and n is a number from 1 to 4; (2) aliphatic mono- and di-carboxylic acids containing 2 to 10 carbon atoms, preferably 3 to 6 carbons in the molecule; (3) the aforementioned alkyl ether polyethenoxy carboxylic acids discussed above, when the anionic carboxylate form of this compound is not present; and (4) triethyl phosphate. Additionally, mixtures of two or more of the four classes of cosurfactant compounds may be employed where specific pH's are desired.

When the mono- and di-carboxylic acid (Class 2) cosurfactants are employed in the instant microemulsion compositions at a concentration of about 2 to 10 wt. %, the microemulsion compositions can be used as a cleaners for bathtubs and other hard surfaced items, which are acid resistant or are made of zirconium white enamel thereby removing lime scale, soap scum and greasy soil from the surfaces of such items damaging such surfaces. An aminoalkylene phophonic acid at a concentration of about 0.01 to about 0.2 wt. % can be optionally used in conjunction with the mono- and di-carboxylic acids, wherein the aminoalkylene phosphonic acid helps prevent damage to zirconium white enamel surfaces. Additionally, 0.05 to 1% of phosphoric acid can be used in the composition.

Representative members of the polypropylene glycol include dipropylene glycol and polypropylene glycol having a molecular weight of 200 to 1000, e.g., polypropylene glycol 400. Other satisfactory glycol ethers are ethylene glycol monobutyl ether (butyl cellosolve), diethylene glycol monobutyl ether (butyl carbitol), triethylene glycol monobutyl ether, mono, di, tri propylene glycol monobutyl ether, tetraethylene glycol monobutyl ether, propylene glycol tertiary butyl ether, ethylene glycol monoacetate and dipropylene glycol propionate.

Representative members of the aliphatic carboxylic acids include $C_3$–$C_6$ alkyl and alkenyl monobasic acids and dibasic acids such as glutaric acid and mixtures of glutaric acid with adipic acid and succinic acid, as well as mixtures of the foregoing acids.

While all of the aforementioned glycol ether compounds and acid compounds provide the described stability, the most preferred cosurfactant compounds of each type, on the basis of cost and cosmetic appearance (particularly odor), are diethylene glycol monobutyl ether and a mixture of adipic, glutaric and succinic acids, respectively. The ratio of acids in the foregoing mixture is not particularly critical and can be modified to provide the desired odor. Generally, to maximize water solubility of the acid mixture glutaric acid, the most water-soluble of these three saturated aliphatic dibasic acids, will be used as the major component. Generally, weight ratios of adipic acid: glutaric acid:-succinic acid is 1–3:1–8:1–5, preferably 1–2:1–6:1–3, such as 1:1:1, 1:2:1, 2:2:1, 1:2:1.5, 1:2:2, 2:3:2, etc. can be used with equally good results.

Still other classes of cosurfactant compounds providing stable microemulsion compositions at low and elevated temperatures are the aforementioned alkyl ether polyethenoxy carboxylic acids and the mono-, di- and triethyl esters of phosphoric acid such as triethyl phosphate.

The amount of cosurfactant required to stabilize the microemulsion compositions will, of course, depend on such factors as the surface tension characteristics of the cosurfactant, the type and amounts of the primary surfactants and perfumes, and the type and amounts of any other additional ingredients which may be present in the composition and which have an influence on the thermodynamic factors enumerated above. Generally, amounts of cosurfactant in the range of from 0% to 50%, preferably from about 0.5% to 15%, especially preferably from about 1% to 7%, by weight provide stable dilute o/w microemulsions for the above-described levels of primary surfactants and perfume and any other additional ingredients as described below.

As will be appreciated by the practitioner, the pH of the final microemulsion will be dependent upon the identity of the cosurfactant compound, with the choice of the cosurfactant being effected by cost and cosmetic properties, particularly odor. For example, microemulsion compositions which have; a pH in the range of 1 to 10 may employ either the class 1 or the class 4 cosurfactant as the sole cosurfactant, but the pH range is reduced to 1 to 8.5 when the polyvalent metal salt is present. On the other hand, the class 2 cosurfactant can only be used as the sole cosurfactant where the product pH is below 3.2. Similarly, the class 3 cosurfactant can be used as the sole cosurfactant where the product pH is below 5. However, where the acidic cosurfactants are employed in admixture with a glycol-ether cosurfactant, compositions can be formulated at a substantially neutral pH (e.g., pH 7±1.5, preferably 7±0.2).

The ability to formulate neutral and acidic products without builders which have grease removal capacities is a feature of the present invention because the prior art o/w microemulsion formulations most usually are highly alkaline or highly built or both.

in addition to their excellent capacity for cleaning greasy and oily soils, the low pH o/w microemulsion formulations also exhibit excellent cleaning performance and removal of soap scum and lime scale in neat (undiluted) as well as in diluted usage.

The final essential ingredient in the inventive microemulsion compositions having improved interfacial tension properties is water. The proportion of water in the microemulsion compositions generally is in the range of 20% to 97%, preferably 70% to 97% by weight of the usual diluted o/w microemulsion composition.

As believed to have been made clear from the foregoing description, the dilute o/w microemulsion liquid all-purpose cleaning compositions of this invention are especially effective when used as is, that is, without further dilution in water, since the properties of the composition as an o/w microemulsion are best manifested in the neat (undiluted) form. However, at the same time it should be understood that depending on the levels of surfactants, cosurfactants, perfume and other ingredients, some degree of dilution without disrupting the microemulsion, per se, is possible. For example, at the preferred low levels of active surfactant compounds (i.e., primary anionic and nonionic detergents) dilutions up to about 50% will generally be well tolerated without causing phase separation, that is, the microemulsion state will be maintained.

However, even when diluted to a great extent, such as a 2- to 10-fold or more dilution, for example, the resulting compositions are still effective in cleaning greasy, oily and other types of soil. Furthermore, the presence of magnesium ions or other polyvalent ions, e.g., aluminum, as will be described in greater detail below further serves to boost cleaning performance of the primary detergents in dilute usage.

On the other hand, it is also within the scope of this invention to formulate highly concentrated microemulsions which will be diluted with additional water before use.

The present invention also relates to a stable concentrated microemulsion or acidic microemulsion composition comprising approximately by weight:

(a) 1 to 30% of an anionic surfactant;
(b) 0.1% to 10% of a grease release agent;
(c) 0.1 to 50% of a cosurfactant;
(d) 0.4 to 10% of a water insoluble hydrocarbon or perfume;
(e) 0 to 18% of at least one dicarboxylic acid;
(f) 0 to 1% of phosphoric acid;
(g) 0 to 0.2% of an aminoalkylene phosphonic acid;
(h) 0 to 15% of magnesium sulfate heptahydrate; and
(i) balance being water.

Such concentrated microemulsions can be diluted by mixing with up to about 20 times or more, preferably about 4 to about 10 times their weight of water to form o/w microemulsions similar to the diluted microemulsion compositions described above. While the degree of dilution is suitably chosen to yield an o/w microemulsion composition after dilution, it should be recognized that during the course of dilution both microemulsion and non-microemulsions may be successively encountered. In addition to the above-described essential ingredients required for the formation of the microemulsion composition, the compositions of this invention may often and preferably do contain one or more additional ingredients which serve to improve overall product performance.

One such ingredient is an inorganic or organic salt of oxide of a multivalent metal cation, particularly $Mg^{++}$. The metal salt or oxide provides several benefits including improved cleaning performance in dilute usage, particularly in soft water areas, and minimized amounts of perfume required to obtain the microemulsion state. Magnesium sulfate, either anhydrous or hydrated (e.g., heptahydrate), is especially preferred as the magnesium salt. Good results also have been obtained with magnesium oxide, magnesium chloride, magnesium acetate, magnesium propionate and magnesium hydroxide. These magnesium salts can be used with formulations at neutral or acidic pH since magnesium hydroxide will not precipitate at these pH levels.

Although magnesium is the preferred multivalent metal from which the salts (inclusive of the oxide and hydroxide) are formed, other polyvalent metal ions also can be used provided that their salts are nontoxic and are soluble in the aqueous phase of the system at the desired pH level. Thus, depending on such factors as the pH of the system, the nature of the primary surfactants and cosurfactant, and so on, as well as the availability and cost factors, other suitable polyvalent metal ions include aluminum, copper, nickel, iron, calcium, etc. It should be noted, for example, that with the preferred paraffin sulfonate anionic detergent calcium salts will precipitate and should not be used. It has also been found that the aluminum salts work best at pH below 5 or when a low level, for example about 1 weight percent, of citric acid is added to the composition which is designed to have a neutral pH. Alternatively, the aluminum salt can be directly added as the citrate in such case. As the salt, the same general classes of anions as mentioned for the magnesium salts can be used, such as halide (e.g., bromide, chloride), sulfate, nitrate, hydroxide, oxide, acetate, propionate, etc.

Preferably, in the dilute compositions the metal compound is added to the composition in an amount sufficient to provide at least a stoichiometric equivalent between the anionic surfactant and the multivalent metal cation. For example, for each gram-ion of $Mg^{++}$ there will be 2 gram moles of paraffin sulfonate, alkylbenzene sulfonate, etc., while for each gram-ion of $A1^{3+}$ there will be 3 gram moles of anionic surfactant. Thus, the proportion of the multivalent salt generally will be selected so that one equivalent of compound will neutralize from 0.1 to 1.5 equivalents, preferably 0.9 to 1.4 equivalents, of the acid form of the anionic detergent. At higher concentrations of anionic detergent, the amount of multivalent salt will be in range of 0.5 to 1 equivalents per equivalent of anionic detergent.

The o/w microemulsion compositions can optionally include from 0% to 5%, preferably from 0.1% to 2.0% by weight of the composition of a $C_8$–$C_{22}$ fatty acid or fatty acid soap as a foam suppressant. The addition of fatty acid or fatty acid soap provides an improvement in the rinseability of the composition whether applied in neat or diluted form. Generally, however, it is necessary to increase the level of cosurfactant to maintain product stability when the fatty acid or soap is present.

As example of the fatty acids which can be used as such or in the form of soap, mention can be made of distilled coconut oil fatty acids, "mixed vegetable" type fatty acids (e.g. high percent of saturated, mono-and/or polyunsaturated $C_{18}$ chains); oleic acid, stearic acid, palmitic acid, eiocosanoic acid, and the like, generally those fatty acids having from 8 to 22 carbon atoms being acceptable.

The microemulsion composition of this invention may, if desired, also contain other components either to provide additional effect or to make the product more attractive to the consumer. The following are mentioned by way of example: Colors or dyes in amounts up to 0.5% by weight; bactericides in amounts up to 1% by weight; preservatives or antioxidizing agents, such as formalin, 5-bromo-5-nitro-dioxan-1,3; 5-chloro-2-methyl-4-isothaliazolin-3-one, 2,6-di-tert.butyl-p-cresol, etc., in amounts up to 2% by weight; and pH adjusting agents, such as sulfuric acid or sodium hydroxide, as needed. Furthermore, if opaque compositions are desired, up to 4% by weight of an opacifier may be added.

In final form, the oil-in-water microemulsions exhibit stability at reduced and increased temperatures. More specifically, such compositions remain clear and stable in the range of 5° C. to 50° C., especially 10° C. to 43° C. Such compositions exhibit a pH in the acid or neutral range depending on intended end use. The liquids are readily pourable and exhibit a viscosity in the range of 6 to 60 milliPascal.second (mPas.) as measured at 25° C. with a Brookfield RVT Viscometer using a #1 spindle rotating at 20 RPM. Preferably, the viscosity is maintained in the range of 10 to 40 mPas.

The compositions are directly ready for use or can be diluted as desired and in either case no or only minimal rinsing is required and substantially no residue or streaks are left behind. Furthermore, because the compositions are free of detergent builders such as alkali metal polyphosphates they are environmentally acceptable and provide a better "shine" on cleaned hard surfaces.

When intended for use in the neat form, the liquid compositions can be packaged under pressure in an aerosol container or in a pump-type sprayer for the so-called spray-and-wipe type of application.

Because the compositions as prepared are aqueous liquid formulations and since no particular mixing is required to form the o/w microemulsion, the compositions are easily prepared simply by combining all the ingredients in a suitable vessel or container. The order of mixing the ingredients is not particularly important and generally the various ingredients can be added sequentially or all at once or in the form of aqueous solutions of each or all of the primary detergents and cosurfactants can be separately prepared and combined with each other and with the perfume. The magnesium salt, or other multivalent metal compound, when present, can be added as an aqueous solution thereof or can be added directly. It is not necessary to use elevated temperatures in the formation step and room temperature is sufficient.

The instant grease release agent can be employed in any type of hard surface cleaning compositions such as nonmicroemulsion, all purpose cleaners and light duty liquid detergents.

The composition of the light duty liquid detergent comprises approximately by weight:

(a) 1 to 50 wt. %, more preferably 2 to 40 wt. % and most preferably 3 to 35 wt. % of at least one surfactant selected from the group consisting of nonionic surfactants, anionic surfactants, zwitterionic surfactants, fatty acid soap surfactants and alkyl polysaccharide surfactants;

(b) 0.1 to 50 wt. %, more preferably 0.4 to 20 wt. % and most preferably 1 to 10 wt. % of a grease release agent;

(c) 0 to 15%, more preferably 1 to 12% of a solubilizing agent; and (d) the balance being water.

The nonionic surfactant can be present in the light duty liquid detergent composition in amounts of about 0 to 50%, preferably 1 to 30%, most preferably 2 to 25%, by weight of the light duty liquid detergent composition and provides superior performance in the removal of oily soil and mildness to human skin.

The water soluble nonionic surfactants utilized in this invention are commercially well known and include the primary aliphatic alcohol ethoxylates, secondary aliphatic alcohol ethoxylates, alkylphenol ethoxylates and ethylene-oxide-propylene oxide condensates on primary alkanols, such a Plurafacs (BASF) and condensates of ethylene oxide with sorbitan fatty acid esters such as the Tweens (ICI). The nonionic synthetic organic detergents generally are the condensation products of an organic aliphatic or alkyl aromatic hydrophobic compound and hydrophilic ethylene oxide groups. Practically any hydrophobic compound having a carboxy, hydroxy, amido, or amino group with a free hydrogen attached to the nitrogen can be condensed with ethylene oxide or with the polyhydration product thereof, polyethylene glycol, to form a water soluble nonionic detergent. Further, the length of the polyethenoxy hydrophobic and hydrophilic elements.

The nonionic detergent class includes the condensation products of a higher alcohol (e.g., an alkanol containing about 8 to 18 carbon atoms in a straight or branched chain configuration) condensed with about 5 to 30 moles of ethylene oxide, for example, lauryl or myristyl alcohol condensed with about 16 moles of ethylene oxide (EO), tridecanol condensed with about 6 to moles of EO, myristyl alcohol condensed with about 10 moles of EO per mole of myristyl alcohol, the condensation product of EO with a cut of coconut fatty alcohol containing a mixture of fatty alcohols with alkyl chains varying from 10 to about 14 carbon atoms in length and wherein the condensate contains either about 6 moles of EO per mole of total alcohol or about 9 moles of EO per mole of alcohol and tallow alcohol ethoxylates containing 6 EO to 11 EO per mole of alcohol.

A preferred group of the foregoing nonionic surfactants are the Neodol ethoxylates (Shell Co.), which are higher aliphatic, primary alcohol containing about 9–15 carbon atoms, such as $C_9$–$C_{11}$ alkanol condensed with 8 moles of ethylene oxide (Neodol 91-8), $C_{12-13}$ alkanol condensed with 6.5 moles ethylene oxide (Neodol 23-6.5), $C_{12-15}$ alkanol condensed with 12 moles ethylene oxide (Neodol 25-12), $C_{14-15}$ alkanol condensed with 13 moles ethylene oxide (Neodol 45-13), and the like. Such ethoxamers have an HLB (hydrophobic lipophilic balance) value of about 8 to 15 and give good O/W emulsification, whereas ethoxamers with HLB values below 8 contain less than 5 ethyleneoxide groups and tend to be poor emulsifiers and poor detergents.

Additional satisfactory water soluble alcohol ethylene oxide condensates are the condensation products of a secondary aliphatic alcohol containing 8 to 18 carbon atoms in a straight or branched chain configuration condensed with 5 to 30 moles of ethylene oxide. Examples of commercially available nonionic detergents of the foregoing type are $C_{11}$–$C_{15}$ secondary alkanol condensed with either 9 EO (Tergitol 15-S-9) or 12 EO (Tergitol 15-S-12) marketed by Union Carbide.

Other suitable nonionic detergents include the polyethylene oxide condensates of one mole of alkyl phenol containing from about 8 to 18 carbon atoms in a straight- or branched chain alkyl group with about 5 to 30 moles of ethylene oxide. Specific examples of alkyl phenol ethoxylates include nonyl condensed with about 9.5 moles of EO per mole of nonyl phenol, dinonyl phenol condensed with about 12 moles of EO per mole of phenol, dinonyl phenol condensed with about 15 moles of EO per mole of phenol and diisoctylphenol condensed with about 15 moles of EO per mole of phenol. Commercially available nonionic surfactants of this type include Igepal CO-630 (nonyl phenol ethoxylate) marketed by GAF Corporation.

Also among the satisfactory nonionic detergents are the water-soluble condensation products of a $C_8$–$C_{20}$ alkanol with a heteric mixture of ethylene oxide and propylene oxide wherein the weight ratio or ethylene oxide to propylene oxide is from 2.5:1 to 4:1, preferably 2.8:1 to 3.3:1, with the total of the ethylene oxide; and propylene oxide (including the terminal ethanol or proponol group) being from 60–85%, preferably 70 to 80%, by weight. Such detergents are commercially available from BASF-Wyandotte and a particularly preferred detergent is a $C_{10}$–$C_{16}$ alkanol condensate with ethylene oxide and propylene oxide, the weight ratio of ethylene oxide to propylene oxide being 3:1 and the total alkoxy content being about 75% by weight.

Condensates of 2 to 30 moles of ethylene oxide with sorbitan mono- and tri-$C_{10}$–$C_{20}$ alkanoic acid esters having a HLB of 8 to 15 also may be employed as the nonionic detergent ingredient in the described shampoo. These surfactants are well known and are available from Imperial Chemical Industries under the Tween trade name. Suitable surfactants include polyoxyethylene (4) sorbitan monolaurate, polyoxyethylene (4) sorbitan monostearate, polyoxyethylene (20) sorbitan trioleate and polyoxyethylene (20) sorbitan tristearate.

Other suitable water-soluble nonionic detergents which are less preferred are marketed under the trade name "Pluronics". The compounds are formed by condensing ethylene oxide with a hydrophobic base formed by the condensation of propylene oxide with propylene glycol. The molecular weight of the hydrophobic portion of the molecule is of the order of 950 to 4000 and preferably 200 to 2,500. The addition of polyoxyethylene radicals to the hydrophobic portion tends to increase the solubility of the molecule as a whole so as to make the surfactant water-soluble. The molecular weight of the block polymers varies from 1,000 to 15,000 and the polyethylene oxide content may comprise 20% to 80% by weight. Preferably, these surfactants will be in liquid form and satisfactory surfactants are available as grades L62 and L64.

The anionic surfactant, used in the light duty liquid detergent composition are the same anionic surfactants as used in the aforementioned microemulsion compositions and, constitutes about 0% to 50%, preferably 1% to 30%, most preferably 2 to 25%, by weight thereof and provides good foaming properties. However, preferably reduced amounts are utilized in order to enhance the mildness of the skin property desired in the inventive compositions.

The water-soluble zwitterionic surfactant, which can also present in the light duty liquid detergent composition, constitutes about 0 to 15%, preferably 1 to 12%, most preferably 2 to 10%, by weight and provides good foaming properties and mildness to the present nonionic based liquid detergent. The zwitterionic surfactant is a water soluble betaine having the general formula:

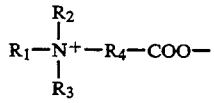

wherein $R_1$ is an alkyl group having 10 to about 20 carbon atoms, preferably 12 to 16 carbon atoms, or the amido radical:

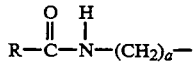

wherein R is an alkyl group having about 9 to 19 carbon atoms and a is the integer 1 to 4; $R_2$ and $R_3$ are each alkyl groups having 1 to 3 carbons and preferably 1 carbon; $R_4$ is an alkylene or hydroxyalkylene group having from 1 to 4 carbon atoms and, optionally, one hydroxyl group. Typical alkyldimethyl betaines include decyl dimethyl betaine or 2-(N-decyl-N,N-dimethylammonia) acetate, coco dimethyl betaine or 2-(N-coco N, N-dimethylammonio) acetate, myristyl dimethyl betaine, palmityl dimethyl betaine, lauryl dimethyl betaine, cetyl dimethyl betaine, stearyl dimethyl betaine, etc. The amidobetaines similarly include cocoamidoethylbetaine, cocoamidopropyl betaine and the like. A preferred betaine is coco ($C_8$–$C_{18}$) amidopropyl dimethyl betaine. The instant light duty liquid detergent composition contains at least 5 wt. % of at least one of the surfactants selected from the group consisting of the nonionic surfactant, the anionic surfactant and the betaine surfactant or a mixture thereof.

All of the aforesaid ingredients in this light duty liquid detergent are water soluble or water dispersible and remain so during storage.

The resultant homogeneous liquid detergent exhibits the same or better foam performance, both as to initial foam volume and stability of foam in the presence of soils, and cleaning efficacy as an anionic based light duty liquid detergent (LDLD) as shown in the following Examples.

The essential ingredients discussed above are solubilized in an aqueous medium comprising water and optionally, solubilizing ingredients such as (monoalkanolamides and dialkanol amides) and alcohols and dihydroxy alcohols such as C2–C3 mono- and dihydroxy alkanols, e.g. ethanol, isopropanol and propylene glycol. Suitable water soluble hydrotropic salts include sodium, potassium, ammonium and mono-, di- and triethanolammonium salts. While the aqueous medium is primarily water, preferably said solubilizing agents are included in order to control the viscosity of the liquid composition and to control low temperature cloud clear properties. Usually, it is desirable to maintain clarity to a temperature in the range of 5° C. to 10° C. Therefore, the proportion of solubilizer generally will be from about 1% to 15%, preferably 2% to 12%, most preferably 3% to 8%, by weight of the detergent composition with the proportion of ethanol, when present, being 5% of weight or less in order to provide a composition having a flash point above about 46° C. Preferably the solubilizing ingredient will be a mixture of ethanol and either sodium xylene sulfonate or sodium cumene sulfonate or a mixture of said sulfonates. Another extremely effective solubilizing or cosolubilizing agent used at a concentration of about 0.1 to 5 wt. percent, more preferably about 0.5 to 4.0 weight percent is isethionic acid or an alkali metal salt of isethionic acid having the formula:

$$CH_2OHCH_2S^-O^+{}_3X$$

wherein X is hydrogen or an alkali metal cation, preferably sodium.

In addition to the previously mentioned essential and optional constituents of the light duty liquid detergent, one may also employ normal and conventional adjuvants, provided they do not adversely affect the properties of the detergent. Thus, there may be used various coloring agents and perfumes; ultraviolet light absorbers such as the Uvinuls, which are products of GAF Corporation; sequestering agents such as ethylene diamine tetraacetates; magnesium sulfate heptahydrate; pearlescing agents and opacifiers; pH modifiers; etc. The proportion of such adjuvant materials, in total will normally not exceed 15% of weight of the detergent composition, and the percentages of most of such individual components will be about 0.1% to 5% by weight and preferably less than about 2% by weight. Sodium formate can be included in the formula as a preservative at a concentration of 0.1 to 4.0%. Sodium bisulfite can be used as a color stabilizer at a concentration of about 0.01 to 0.2 wt. %. Typical preservatives are dibromodicyano-butane, citric acid, benzylic alcohol and poly (hexamethylene-biguamide) hydro-chloride and mixtures thereof.

The instant light duty liquid detergent compositions can contain about 0.1 to about 4 wt. %, more preferably about 0.5 to 3.0 wt. % of an alkyl polysaccharide surfactant. The alkyl polysaccharides surfactants, which are used in conjunction with the aforementioned surfactants have a hydrophobic group containing from about 8 to about 20 carbon atoms, preferably from about 10 to about 16 carbon atoms, most preferably from about 12 to about 14 carbon atoms, and polysaccharide hydrophilic group containing from about 1.5 to about 10, preferably from about 1.5 to about 4, most preferably from about 1.6 to about 2.7 saccharide units (e.g., galactoside, glucoside, fructoside, glucosyl, fructosyl; and/or galactosyl units). Mixtures of saccharide moieties may be used in the alkyl polysaccharide surfactants. The number x indicates the number of saccharide units in a particular alkyl polysaccharide surfactant. For a particular alkyl polysaccharide molecule x can only assume integral values. In any physical sample of alkyl polysaccharide surfactants there will be in general molecules having different x values. The physical sample can be characterized by the average value of x and this average value can assume non-integral values. In this specification the values of x are to be understood to be average values. The hydrophobic group (R) can be attached at the 2-, 3-, or 4- positions rather than at the 1-position, (thus giving e.g. a glucosyl or galactosyl as opposed to a glucoside or galactoside). However, attachment through the 1- position, i.e., glucosides, galactoside, fructosides, etc., is preferred. In the preferred product the additional saccharide units are predominately attached to the previous saccharide unit's 2-position. Attachment through the 3-, 4-, and 6- positions can also occur. Optionally and less desirably there can be a polyalkoxide chain joining the hydrophobic moiety (R) and the polysaccharide chain. The preferred alkoxide moiety is ethoxide.

Typical hydrophobic groups include alkyl groups, either saturated or unsaturated, branched or unbranched containing from about 8 to about 20, preferably from about 10 to about 18 carbon atoms. Preferably, the alkyl group is a straight chain saturated alkyl group. The alkyl group can contain up to 3 hydroxy groups and/or the polyalkoxide chain can contain up to about 30, preferably less than about 10, alkoxide moieties.

Suitable alkyl polysaccharides are decyl, dodecyl, tetradecyl, pentadecyl, hexadecyl, and octadecyl, di-, tri-, tetra-, penta-, and hexaglucosides, galactosides, lactosides, fructosides, fructosyls, lactosyls, glucosyls and/or galactosyls and mixtures thereof.

The alkyl monosaccharides are relatively less soluble in water than the higher alkyl polysaccharides. When used in admixture with alkyl polysaccharides, the alkyl monosaccharides are solubilized to some extent. The use of alkyl monosaccharides in admixture with alkyl polysaccharides is a preferred mode of carrying out the invention. Suitable mixtures include coconut alkyl, di-, tri-, tetra-, and pentaglucosides and tallow alkyl tetra-, penta-, and hexaglucosides.

The preferred alkyl polysaccharides are alkyl polyglucosides having the formula $$R_2O(C_nH_{2n}O)r(Z)_x$$

wherein Z is derived from glucose, R is a hydrophobic group selected from the group consisting of alkyl, alkylphenyl, hydroxyalkylphenyl, and mixtures thereof in which said alkyl groups contain from about 10 to about 18, preferably from about 12 to about 14 carbon atoms; n is 2 or 3 preferably 2, r is from 0 to 10, preferable 0; and x is from 1.5 to 8, preferably from 1.5 to 4, most preferably from 1.6 to 2.7. To prepare these compounds a long chain alcohol ($R_2OH$) can be reacted with glucose, in the presence of an acid catalyst to form the desired glucoside. Alternatively the alkyl polyglucosides can be prepared by a two step procedure in which a short chain alcohol ($R_1$ OH) can be reacted with glucose, in the presence of an acid catalyst to form the desired glucoside. Alternatively the alkyl polyglucosides can be prepared by a two step procedure in which a short chain alcohol ($C_{1-6}$) is reacted with glucose or a polyglucoside (x=2 to 4) to yield a short chain alkyl glucoside (x=1 to 4) which can in turn be reacted with a longer chain alcohol ($R_2OH$) to displace the short chain alcohol and obtain the desired alkyl polyglucoside. If this two step procedure is used, the short chain alkylglucoside content of the; final alkyl polyglucoside material should be less than 50%, preferably less than 10%, more preferably less than about 5%, most preferably 0% of the alkyl polyglucoside.

The amount of unreacted alcohol (the free fatty alcohol content) in the desired alkyl polysaccharide surfactant is preferably less than about 2%, more preferably less than about 0.5% by weight of the total of the alkyl polysaccharide. For some uses it is desirable to have the alkyl monosaccharide content less than about 10%.

The used herein, "alkyl polysaccharide surfactant" is intended to represent both the preferred glucose and galactose derived surfactants and the less preferred alkyl polysaccharide surfactants. Throughout this specification, "alkyl polyglucoside" is used to include alkyl polyglycosides because the stereochemistry of the saccharide moiety is changed during the preparation reaction.

An especially preferred APG glycoside surfactant is APG 625 glycoside manufactured by the Henkel Corporation of Ambler, Pa. APG25 is a nonionic alkyl polyglycoside characterized by the formula:

$$C_nH_{2n+1}O(C_6H_{10}O_5)_xH$$

wherein n=10 (2%); n=122 (65%); n=14 (21–28%); n=16 (4–8%) and x (degree of polymerization)=1.6. APG 625 has: a pH of 6 to 10 (10% of APG 625 in distilled water); a specific gravity at 25° C. of 1.1 g/ml; a density at 25° C. of 9.1 lbs/gallon; a calculated HLB of 12.1 and a Brookfield viscosity at 35° C., 21 spindle, 5–10 RPM of 3,000 to 7,000 cps.

The instant compositions can contain a silk derivatives as part of the composition and generally constitute about 0.01 to 3.0% by weight, preferably about 0.1 to 3.0% by weight, most preferably 0.2 to 2.5% by weight of the liquid detergent composition.

Included among the silk derivatives are silk fibers and hydrolyzate of silk fibers. The silk fibers may be used in the form of powder in preparing the liquid detergent or as a powder of a product obtained by washing and treating the silk fibers with an acid. Preferably, silk fibers are used as a product obtained by hydrolysis with an acid, alkali or enzyme, as disclosed in Yoshiaki Abe et al., U.S. Pat. No. 4,839,168; Taichi Watanube et al., U.S. Pat. No. 5,009,813; and Marvin E. Goldberg, U.S. Pat. No. 5,069,898, each incorporated herein by reference.

Another silk derivative which may be employed in the composition of the present invention is protein obtained from degumming raw silk, as disclosed, for example, in Udo Hoppe et al., U.S. Pat. No. 4,839,165, incorporated herein by reference. The principal protein obtained from the raw silk is sericin which has an empirical formula of $C_{15}H_{25}O_3N_5$ and a molecular weight of 323.5.

Another example of a silk derivative for use in the liquid detergent composition of the present invention is a fine powder of silk fibroin in nonfibrous or particulate form, as disclosed in Kiyoshi Otoi et al., U.S. Pat. No. 4,:233,212, incorporated herein by reference.

The fine powder is produced by dissolving a degummed silk material in at least one solvent selected from, for example, an aqueous cupriethylene diamine solution, an aqueous ammoniacal solution of cupric hydroxide, an aqueous alkaline solution of cupric hydroxide and glycerol, an aqueous lithium bromide solution, an aqueous solution of the chloride, nitrate or thiocyanate of calcium, magnesium or zinc and an aqueous sodium thiocyanate solution. The resulting fibroin solution is then dialyzed. The dialyzed aqueous silk fibroin solution, having a silk fibroin concentration of from about 3 to 20% by weight, is subjected to at least one treatment for coagulating and precipitating the silk fibroin, such as, for example, by the addition of a coagulating salt, by aeration, by coagulation at the isoelectric point, by exposure to ultrasonic waves, by agitation at high shear rate and the like.

The resulting product is a silk fibroin gel which may be incorporated directly into the liquid detergent composition or the same may be dehydrated and dried into a powder and then dissolved in the liquid detergent composition.

The silk material which may be used to form the silk fibroin includes cocoons, raw silk, waste cocoons, raw silk waste, silk fabric waste and the like. The silk material is degummed or freed from sericin by a conventional procedure such as, for example, by washing in warm water containing a surfact-active agent or an enzyme, and then dried. The degummed material is dissolved in the solvent and preheated to a temperature of from 60° to 95° C., preferably 70° to 85° C. Further details of the process of obtaining the silk fibroin are discussed in U.S. Pat. No. 4,233,212.

A preferred silk derivative is a mixture of two or more individual amino acids which naturally occur in silk. The principal silk amino acids are glycine, alanine, serine and tyrosine.

A silk amino acid mixture resulting from the hydrolysis of silk of low molecular weight and having a specific gravity of at least 1 is produced by Croda, Inc. and sold under the trade name "CROSILK LIQUID" which typically has a solids content in the range of about 27 to 31% by weight. Further details of the silk amino acid mixture can be found in Wendy W. Kim et al., U.S. Pat. No. 4,906,460, incorporated herein by reference. A typical amino acid composition of "CROSILK LIQUID" is shown in the following Table.

| AMINO ACID | PERCENT BY WEIGHT |
|---|---|
| Alanine | 28.4 |
| Glycine | 34.7 |
| Valine | 2.0 |
| Leucine | 1.2 |
| Proline | 1.2 |
| Tyrosine | 0.6 |
| Phenylalanine | 0.9 |
| Serine | 15.4 |
| Threonine | 1.9 |
| Arginine | 1.5 |
| Aspartic Acid | 4.7 |
| Glutamic Acid | 4.1 |
| Isoleucine | 0.8 |
| Lysine | 1.4 |
| Histidine | 0.8 |
| Cystine | 0.1 |
| Methionine | 0.2 |
| TOTAL | 99.9 |

The instant compositions can contain a viscosity modifying solvent at a concentration of about 0.1 to 5.0 weight percent, more preferably about 0.5 to 4.0 weight percent. The viscosity modifying agent is an alcohol of the formula

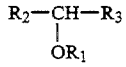

wherein $R_1 = CH_3$, $CH_2CH_3$ $R_2 = CH_3$, $CH_2CH_3$ $R_3 = CH_2OH$, $CH_2CH_2OH$;

which is preferably 3-methyl-3-methoxy-butanol.

The 3-methyl-3-methoxy butanol is commercially available from Sattva Chemical Company of Stamford, Conn. and Kuraray Co., Ltd., Osaka, Japan.

The instant composition can contain about 0.1 to 4.0% of a protein selected from the group consisting of hydrolyzed animal collagen protein obtained by an enzymatic hydrolysis, lexeine protein, vegetal protein and hydrolyzed wheat protein and mixtures thereof.

The present light duty liquid detergents such as dishwashing liquids are readily made by simple mixing methods from readily available components which, on storage, do not adversely affect the entire composition. However, it is preferred that the nonionic surfactant, if present, be mixed with the solubilizing ingredients, e.g., ethanol and, if present, prior to the addition of the water to prevent possible gelation. The surfactant system is prepared by sequentially adding with agitation the anionic surfactant, the betaine and the grease release agent to the non-ionic surfactant which has been previously mixed with a solubilizing agent such as ethyl alcohol and/or sodium xylene sulfonate to assist in solubilizing said surfactants, and then adding with agitation the formula amount of water to form an aqueous solution of the surfactant system. The use of mild heating (up to 100° C.) assists in the solubilization of the surfactants. The viscosities are adjustable by changing the total percentage of active ingredients. No polymeric or clay thickening agent is added. In all such cases the product made will be pourable from a relatively narrow mouth bottle (1.5 cm. diameter) or opening, and the viscosity of the detergent formulation will not be so low as to be like water. The viscosity of the detergent desirably will be at least 100 centipoises (cps) at room temperature, but may be up to about 1,000 centipoises as measured with a Brookfield Viscometer using a number 3 spindle rotating at 12 rpm. Its viscosity may approximate those of commercially acceptable detergents now on the market. The detergent viscosity and the detergent itself remain stable on storage for lengthy periods of time, without color changes or settling out of any insoluble materials. The pH of this formation is substantially neutral to skin, e.g., about 4.5 to 8 and preferably about 5.5 to about 5.0.

This invention also relates to all purpose hard surface cleaner composition which comprises at least one surfactant, a grease release agent, a magnesium containing inorganic compound, perfume and water.

The at least one surfactant is selected from the group consisting of nonionic surfactants and anionic surfactants, wherein said surfactants are selected from the name aforementioned surfactants used in forming the microemulsion compositions of the instant invention. The concentration of the anionic surfactant is about 0 to 20 wt. %, more preferably about 1 to about 10 wt. % and the concentration of the nonionic surfactant is about 0.1 to about 10 wt. %, more preferably about 0.5 to 6 wt. %.

The grease release agent is the same as that used in the microemulsion composition and constitutes about 0.1 to 15 wt. %, more preferably about 1 to 10 wt. % of the all purpose hard surface cleaner composition.

The magnesium inorganic compound is preferably magnesium sulfate heptahydrate and constitutes about 0.1 to 5 wt. %, more preferably 0.4 to 3 wt. % of the instant composition.

The perfumes which are selected from the same group of perfumes as in the microemulsion compositions constitute less than 0.3 wt. % of the composition, preferably 0.05 to 0.3 wt. % of the all purpose hard surface cleaner composition.

The following examples are merely illustrative of the invention and are not to be construed as limiting thereof.

The following examples illustrate liquid cleaning compositions of the described invention. Unless otherwise specified, all percentages are by weight. The exemplified compositions are illustrative only and do not limit the scope of the invention. Unless otherwise specified, the proportions in the examples and elsewhere in the specification are by weight.

EXAMPLE 1

The following microemulsion compositions in wt. % were prepared:

| | A = +choline Cl | B = +stepan quat T | C = +stepan quat X8413 | D = current Ajar APC tm NME |
|---|---|---|---|---|
| Sodium C13–C17 Alkyl Sulfonate | 4.0 | 4.0 | 4.0 | 4.0 |
| DEGMBE | 3.5 | 3.5 | 3.5 | 3.5 |
| MgSO4 7 H2O | 1.5 | 1.5 | 1.5 | 1.5 |
| Perfume (a) | 0.8 | 0.8 | 0.8 | 0.8 |
| Fatty acid | 0.5 | 0.5 | 0.5 | 0.5 |
| Choline chloride | 4.0 | 4.0 | 4.0 | — |
| Fatty alcohol C13–15, 7EO, 4PO | 3.0 | 3.0 | 3.0 | 3.0 |
| Colorant | 0.002 | 0.002 | 0.002 | 0.002 |
| Preservative | 0.2 | 0.2 | 0.2 | 0.2 |
| Water | 82.5 | 82.5 | 82.5 | 86.5 |
| pH | 6.8 | 6.8 | 6.8 | std |
| Degreasing test | | | | |
| Neat (b) | equal | equal | equal | std |
| Dilute (b) | slightly better | equal | equal | std |
| Residue | equal | equal | equal | std |

-continued

| | A = +choline Cl | B = +stepan quat T | C = +stepan quat X8413 | D = current Ajar APC tm NME |
|---|---|---|---|---|
| Foam in hard Water | equal | equal | equal | std |

(a) contains about 25% by weight of terpenes.
(b) the lower the number of strokes, the better the degreasing performance.
(c) Manufactured by Colgate-Palmolive Co.

Furthermore, "dissolution power" of the o/w microemulsion of this example is compared to the "dissolution power" of an identical composition except that an equal amount (5 weight percent) of sodium cumene sulfonate hydrotrope is used in place of the diethylene glycol monobutyl ether cosurfactant in a test wherein equal concentrations of heptane are added to both compositions. The o/w microemulsion of this invention solubilizes 12 grams of the water immiscible substance as compared to 1.4 grams in the hydrotrope containing liquid composition.

In a further comparative test using blue colored cooking oil—a fatty triglyceride soil—, the composition of Example 1 is clear after the addition of 0.2 grams of cooking oil whereas the cooking oil floats on the top of the composition containing the sulfonate hydrotrope.

When the concentration of perfume is reduced to 0.4% in the composition of Example 1, a stable o/w microemulsion composition is obtained. Similarly, a stable o/w microemulsion is obtained when the concentration of perfume is increased to 2% by weight and the concentration of cosurfactant is increased to 6% by weight in Example 1.

EXAMPLE 2

The example illustrates a typical formulation of a "concentrated" o/w microemulsion based on the present invention:

| | % by weight |
|---|---|
| Sodium C13–C17 alkyl sulfonate | 12 |
| diethylene glycol monobutyl ether | 8.4 |
| Choline chloride | 2.5 |
| Perfume (a) | 2.4 |
| $MgSO_4.7H_2O$ | 4.5 |
| Fatty alcohol $C_{13}$–$C_{15}$, 7 EO, 4 PO | 7.2 |
| Fatty acid | 1.5 |
| Water | 61.5 |
| pH: 7.0 ± 0.2 | |

This concentrated formulation can be easily diluted, for example, three times with tap water, to yield a diluted o/w microemulsion composition. Thus, by using microemulsion technology it becomes possible to provide a product having high levels of active detergent ingredients and perfume, which has high consumer appeal in terms of clarity, odor and stability, and which is easily diluted at the usual usage concentration for similar all-purpose hard surface liquid cleaning compositions, while retaining its cosmetically attractive attributes.

Naturally, these formulations can be used, where desired, without further dilution and can also be used at full or diluted strength to clean soiled fabrics by hand or in an automatic laundry washing machine.

EXAMPLE 3

This example illustrates a diluted o/w microemulsion composition according to the invention having an acidic pH and which also provides improved cleaning performance on soap scum and lime scale removal as well as for cleaning greasy soil.

| | % by weight |
|---|---|
| Sodium $C_{13}$—$C_{17}$ alkyl sulfonate | 4.0 |
| Cholrine chloride | 4.0 |
| Mg $SO_4$ $7H_2O$ | 1.5 |
| Mixture of succinic acid/glutaric acid/ adipic acid (1:1:1) | 5.0 |
| Phosphoric acid | 0.22 |
| Perfume (d) | 0.8 |
| dye | 0.002 |
| preservative | 0.3 |
| amino alkylene phosphonic acid | 0.25 |
| Water, minors (dye) | balance to 100 |
| pH = 3 ± 0.2 | |

EXAMPLE 4

Formulas A, B, C of Example 1, as well as neutral concentrated o/w microemulsion (Example 2) and acidic o/w microemulsion composition (Example 3) were tested for a grease release effect and compared to commercial Ajax TM NME.

I. GREASE RELEASE EFFECT

Test Method

A) Surface treatment by diluted (1.2% in tap water) or neat tested formula:

1. Pretreatment of half ceramic tile by the prototype, the other one by the reference (current AJAX); the pretreatment consists in:
   a. display the product on the tile by sponges: 10 strokes
   b. let simply dry in the air or
   c. wet wipe with wet sponges: 5 strokes or
   d. wipe dry with paper towel: 5 strokes the surface
2. Spraying hot grease on the surface
3. first cleaning with neat or diluted products
4. drying, or wet wiping or wipe drying
5. second spraying followed by second cleaning B) Soil Composition:

20% hardened tallow
80% beef tallow fat blue dye c) Soil preparation:

The fat mixture is heated and sprayed with an automatic spraying device on cleaned and dried ceramic tiles.

D) Soil removal:

Product used neat: 2.5 g on sponge
Product used dilute: 1.2% sol in tap water—10 ml of the solution on the sponge
The cleaning procedure is done with the gardner device for both product concentrations.

Results

A) On pretreated ceramic tiles:

a. treated with the diluted product; drying in open air before spraying the soil

| | number of strokes for first cleaning | number of strokes for second cleaning after drying in open air |
|---|---|---|
| Formula A | 3 | 2 |
| AJAX APC NME | 18 | 20 |
| Formula B | 5 | 3 |
| AJAX APC NME | 22 | 10 |
| Formula C | 3 | 3 |
| AJAX APC NME | 15 | 14 |

b. treated with the diluted product; wipe with paper towel before spraying the soil

| | number of strokes for first cleaning | number of strokes for the second cleaning after wipe with paper towel |
|---|---|---|
| Formula A | 20 | 18 |
| AJAX APC NME | 20 | 18 |
| Formula B | 23 | 10 |
| AJAX APC NME | 29 | 12 |
| Formula C | 21 | 9 |
| AJAX APC NME | 33 | 11 |

c. treated with the diluted product; wipe with wet sponges

| | number of strokes for first cleaning | number of strokes for the second cleaning after wipe with wet sponges |
|---|---|---|
| Formula A | 10 | 22 |
| AJAX APC NM E | 17 | 24 |
| Formula B | 20 | 8 |
| AJAX APC NME | 28 | 10 |
| Formula C | 27 | 12 |
| AJAX APC NME | 46 | 22 |

d. treated by neat bathroom products (pH = 3); drying in open air before spraying the soil

| | number of strokes for first cleaning | number of strokes for second cleaning after drying in open air |
|---|---|---|
| Prototype containing chorine chloride | 21 | 8 |
| Current bathroom product | 53 | 15 |

e. treated by concentrated ajax (3:1); drying in open air before spraying the soil

| | number of strokes for first cleaning | number of strokes for second cleaning after drying in open air |
|---|---|---|
| concentrated prototype_containing choline chloride | 10 | 15 |
| concentrated Ajax NME | 13 | 15 |

B) On untreated ceramic tiles a. cleaning by the diluted product conditions: between first and second cleaning let dry in the open air

| | number of strokes for the first cleaning | number of strokes for the second cleaning after drying in the open air |
|---|---|---|
| Formula A | 30 | 5 |
| AJAX APC NME | 30 | 18 |
| Formula B | 14 | 15 |
| AJAX APC NME | 14 | 15 |
| Formula C | 26 | 13 |
| AJAX APC NME | 26 | 18 |

b. cleaning by the diluted product conditions: between first and second cleaning wipe with wet sponges

| | number of strokes for the first cleaning | number of strokes for the second cleaning after wiping with wet sponges |
|---|---|---|
| Formula A | 19 | 19 |
| AJAX APC NME | 19 | 19 |
| Formula B | 12 | 17 |
| AJAX APC NME | 12 | 17 |
| Formula C | 30 | 12 |
| AJAX APC NME | 30 | 14 |

c. cleaning by neat bathroom product (pH = 3)

conditions: between first and second cleaning let dry in the open air

| | number of strokes for the first cleaning | number of strokes for the second cleaning after drying in the open air |
|---|---|---|
| Prototype containing choline chloride | 22 | 9 |

-continued

| | | |
|---|---|---|
| Current bathroom product | 22 | 12 |

d. cleaning by concentrated (3:1) Ajax APC NME
conditions: betwwen the first and the second cleaning let dry in the open air

| | number of strokes for the first cleaning | number of strokes for the second cleaning after drying in the open air |
|---|---|---|
| concentrated prototype_containing choline chloride | 23 | 19 |
| concentrated Ajax NME | 23 | 19 |

These results clearly demonstrate the important grease release effect obtained with formulas A, B, C, as well as acidic microemulsion, especially when the product is used diluted.

EXAMPLE 5

The following light duty liquid detergent compositions was made according to the previously defined simple mixing procedure.

| | A | B |
|---|---|---|
| Na C13-17 paraffin sulfonate | 20.83 | 20.83 |
| Na C12-14 alcohol EO2:1 sulfate | 21.42 | 21.42 |
| C10-12 alcohol EO7:1 | 1.25 | 1.25 |
| Choline Chloride | 4 | — |
| Water + minors | Balance | Balance |
| pH | 7 | 7 |
| Brookfield viscosity, RT, #2 spindle, 30 rpms (cps) | 150 | 150 |
| Degreasing test | | |
| Neat | Equal to std | Equal to std |
| Dilute | Equal to std | Equal to std |

EXAMPLE 6

The following light duty liquid detergent composition was made according to the previously defined mixing procedure.

| | A | B |
|---|---|---|
| Neodol 1-9 | 19 | 19 |
| Ammonium laurylsulfate | 6 | 6 |
| Cocoamidopropyl betaine | 5 | 5 |
| Alkylmonoethanol amide | 2 | 2 |
| Alkyl diethanol amide | 2 | 2 |
| Chlorine chloride | 4 | — |
| Degreasing test | | |

-continued

| | A | B |
|---|---|---|
| neat (b) | equal | std |
| dilute (b) | equal | std |

The beginning of the cleaning is much faster for the formula A than for the formula B.

EXAMPLE 7

The following light duty liquid detergent compositions were made according to the previously defined mixing procedure,

| | A | B |
|---|---|---|
| Neodol 1-9 | 20 | 20 |
| Cocoamido Propyl betaine | | 5 |
| Choline Chloride | 4 | 4 |
| Grease release effect | Yes | Yes |

EXAMPLE 8

The following all purpose hard surface cleaning compositions were made according to the previously defined procedure.

| | Formula A | Formula B |
|---|---|---|
| C9-C13 LA Sulfonic acid | 3.4 | 3.4 |
| C8-C10 alcohol EO 5:1 | 2.0 | 2.0 |
| sodium carbonate anhydrous | 4.0 | 4.0 |
| sodium bicarbonate | 2.0 | 2.0 |
| ammonium chloride crystals | 1.25 | 1.25 |
| choline chloride | 4.0 | — |
| water | balance | balance |

Grease release results

1. Pretreated ceramic tiles
1.a. Treated with the neat product; drying in open air before spraying the soil

| | number of strokes for first cleaning | number of strokes for second cleaning after drying in open air |
|---|---|---|
| Formula A | 12 | 8 |
| Formula B | 14 | 12 |

1.a. Treated with the diluted product; drying in open air before spraying the soil

| | number of strokes for first cleaning | number of strokes for second cleaning after drying in open air |
|---|---|---|
| Formula A | 4 | 5 |
| Formula B | 21 | 28 |

2. Non pretreated tiles
Cleaning with diluted products.

| | number of strokes for first cleaning | number of strokes for second cleaning after drying in open air |
|---|---|---|
| Formula A | 32 | 6 |
| Formula B | 32 | 24 |

-continued

II. Results showing superior grease release effect of the Levenol formula (M. Mondin), containing Choline chloride.

1. Pretreated ceramic tiles 1.a. Treated with the neat product; drying in open air before spraying the soil

| | number of strokes for first cleaning | number of strokes for second cleaning after drying in open air |
|---|---|---|
| Levenol + Choline chloride formula | 24 | 23 |
| current AJAX NME | 46 | 40 |

1.a. Treated with the neat product; wiping with wet sponges before spraying the soil

| | number of strokes for first cleaning | number of strokes for second cleaning after drying in open air |
|---|---|---|
| Levenol + Choline chloride formula | 32 | 19 |
| current AJAX NME | 53 | 27 |

1.a. Treated with the diluted product; drying in open air before spraying the soil

| | number of strokes for first cleaning | number of strokes for second cleaning after drying in open air |
|---|---|---|
| Levenol + Choline chloride formula | 3 | 2 |
| current AJAX NME | 18 | 19 |

1.a. Treated with the diluted product; wiping with wet sponges before spraying the soil

| | number of strokes for first cleaning | number of strokes for second cleaning after drying in open air |
|---|---|---|
| Levenol + Choline chloride formula | 9 | 12 |
| current AJAX NME | 20 | 21 |

2. Non pretreated tiles

Cleaning with diluted products.

| | number of strokes for first cleaning | number of strokes for second cleaning after drying in open air |
|---|---|---|
| Levenol + Choline chloride formula | 27 | 3 |
| current AJAX NME | 30 | 14 |

In summary, the described invention broadly relates to an improvement in microemulsion compositions containing an anionic surfactant, a nonionic surfactant, a cosurfactant, a hydrocarbon ingredient and water which comprise the use of a water-insoluble, odoriferous perfume as the essential hydrocarbon ingredient in a proportion sufficient to form either a dilute o/w microemulsion composition containing, by weight, 0.1% to 20% of an anionic detergent, 1% to 10% of a grease release agent; 0.1% to 50% of cosurfactant, 0.4% to 10% of perfume and the balance being water as well as to the previously described all purpose hard surface cleaner or light duty liquid detergent compositions having incorporated therein a grease release agent.

What is claimed:

1. A stable microemulsion hard surface cleaning composition comprising approximately by weight: 0.1% to 20% of a nonsoap anionic surfactant, 0.1% to 20% of a nonionic surfactant, 0.1% to 50% of a cosurfactant selected front the group consisting of water-soluble $C_3$–$C_4$ alkanols, polypropylene glycol and $C_1$–$C_4$ mono alkyl ethers and esters of mono ethylene glycol or mono propylene glycol, aliphatic mono- and di-carboxylic adds containing 3 to 6 carbons in the molecule, 0.1% to 10% of a grease release agent, 0.1% to 10% of a water insoluble hydrocarbon or a perfume and the balance being water, wherein the grease release agent consists of

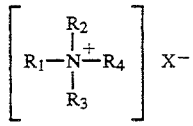

wherein $R_1$ is a methyl group and $R_2$, $R_3$ and $R_4$ are independently selected from the group consisting of $CH_3$, $C_2H_5$, $CH_2CH_2Y$, wherein Y is selected from the group consisting of Cl, Br, $CO_2H$, $(CH_2O)_nOH$, wherein n is 1 to 10, and OH, and X is selected from the group consisting of Cl, Br, methosulfate and $HCO_3$—.

2. A stable, clear, all-purpose, hard surface cleaning composition which is especially effective in the removal of oily and greasy soil being in the form of an oil-in-water microemulsion (o/w), the aqueous phase of said microemulsion composition comprising approximately by weight: from about 0.1% to 20% of a nonsoap anionic surfactant; from about 0.1% to about 10% of a grease release agent wherein the grease release agent consists of

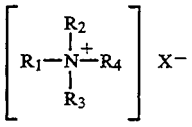

wherein $R_1$ is a methyl group and $R_2$, $R_3$ and $R_4$ are independently selected from the group consisting of $CH_3$, $C_2H_5$, $CH_2CH_2Y$, wherein Y is selected from the group consisting of Cl, Br, $CO_2H$, $(CH_2O)_nOH$, wherein n is 1 to 10, and OH and X is selected from the group consisting of Cl, Br, methosulfate and $HCO_3$—; from about 0.1% to about 50% of a water-miscible cosurfactant having substantially no ability to dissolve oily or greasy soil selected from the group consisting of water-soluble $C_3$–$C_4$ alkanols, polypropylene glycol and $C_1$–$C_4$ alkyl ethers and esters of ethylene glycol or propylene glycol, aliphatic mono- and di-carboxylic acids containing 3 to 6 carbons in the molecule, $C_5$–$C_{15}$ alkyl ether polyethenoxy carboxylic acids of the structural formula $R(OC_2H_4)_nOX$ COOH wherein R is $C_9$–$C_{15}$ alkyl, n is a number from 4 to 12 and X is selected from the group consisting of $CH_2$, $C(O)R_1$ and C(O), wherein $R_1$ is a $C_1$–$C_3$ alkylene group and mono-, di- and triethyl phosphate and water; the oil phase of said microemulsion consisting essentially of a water-immiscible or hardly water-soluble hydrocarbon ingredient in an amount of from about 0.1% to about 10% by wright of the entire compulsion, said composition being particularly effective in removing oily or greasy soil from hard surfaces by solubilizing the oily or greasy soil in the oil phase of said microemulsion.

3. The cleaning composition of claim 1 which further contains a salt of a multivalent metal cation in an amount sufficient to provide from 0.5 to 1.5 equivalents of said cation per equivalent of said anionic detergent.

4. The cleaning composition of claim 3 wherein the multivalent metal cation is magnesium or aluminum.

5. The cleaning composition of claim 3, wherein said composition contains 0.9 to 1.4 equivalents of said cation per equivalent of anionic detergent.

6. The cleaning composition of claim 4 wherein said multivalent salt is magnesium oxide or magnesium sulfate

7. The cleaning composition of claim 1 which contains from about 0.5 to 15% by weight of said cosurfactant and from about 0.4% to about 3.0% by weight of said hydrocarbon.

8. The cleaning composition of claim 2 wherein the cosurfactant is a water soluble glycol ether.

9. The cleaning composition of claim 8 wherein the glycol ether is selected from the group consisting of ethylene glycol monobutylether, diethylene glycol monobutyl ether, triethylene glycol monobutylether, poly-propylene glycol having an average molecular weight of from about 200 to 1,000 and propylene glycol tert.butyl ether, and mono, di, tri propylene glycol monobutyl ether.

10. The cleaning composition of claim 9 wherein the glycol ether is ethylene glycol monobutyl ether or diethylene glycol monobutyl ether.

11. The cleaning composition of claim 1 wherein the cosurfactant is a $C_3$–$C_6$ aliphatic carboxylic acid selected from the group consisting of acrylic acid, propionic acid, glutaric acid, mixtures of glutaric acid and succinic acid and adipic acid and mixtures of any of the foregoing.

12. The cleaning composition of claim 11 wherein the aliphatic carboxylic acid is a mixture of adipic acid, glutaric acid and succinic acid.

13. The cleaning composition of claim 1 wherein the anionic surfactant is a $C_9$–$C_{15}$ alkyl benzene sulfonate or a $C_{10}$–$C_{20}$ alkane sulfonate.

14. A stable concentrated microemulsion hard surface cleaning composition comprising approximately by weight:

(a) 1 to 30% of a nonsoap anionic surfactant;

(b) 0.1 to 3% of a grease release agent wherein the grease release agent consists of

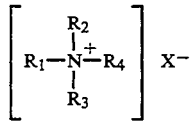

wherein $R_1$ is a methyl group and $R_2$, $R_3$ and $R_4$ are independently selected from the group consisting of $CH_3$, $C_2H_5$, $CH_2CH_2Y$, wherein Y is selected from the group consisting of Cl, Br, $CO_2H$, $(CH_2O)_nOH$, wherein n is 1 to 10, and OH, and X is selected from the group consisting of Cl, Br, methosulfate and $HCO_3$—;

(c) 2 to 30% of a cosurfactant selected from the group consisting of water soluble $C_3$–$C_4$ alkanols, polypropylene glycol and $C_1$–$C_4$ mono alkyl ethers and esters of mono ethylene glycol or mono propylene glycol, aliphatic mono- and di-carboxylic acids containing 3 to 6 carbons in the molecule;

(d) 0.4 to 10% of a water insoluble hydrocarbon or perfume;

(e) 0 to 18% of at least one dicarboxylic acid;

(f) 0 to 0.2 % of an aminoalkylene phosphoric acid;

(g) 0 to 1.0% of a phosphoric acid;

(h) 0 to 15% of magnesium sulfate heptahydrate; and (i) the balance being water.

15. A all purpose hard surface cleaning composition which comprises approximately by weight:

(a) 1 to 30% of at least one surfactant;

(b) 0.1 to 3% of a grease release agent wherein the grease release agent consists of

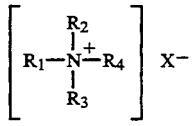

wherein $R_1$ is a methyl group and $R_2$, $R_3$ and $R_4$ are independently selected from the group consisting of $CH_3$, $C_2H_5$, $CH_2CH_2Y$, wherein Y is selected from the group consisting of Cl, Br, $CO_2H$, $(CH_2O)_nH$, wherein n is 1 to 10, and OH, and X is selected from the group consisting of Cl Br, methosulfate and $HCO_3$—;

(c) 0.1 to 5% of a magnesium containing inorganic compound;

(d) 1 to 15% of a cosurfactant selected from the group consisting of water-soluble $C_3$–$C_4$ alkanols, polypropylene glycol and $C_1$–$C_4$ mono alkyl ethers and esters of mono ethylene glycol or mono propylene glycol, aliphatic mono- and di-carboxylic acids containing 3 to 6 carbons in the molecule; and (e) the balance being water.

16. A light duty liquid detergent comprising approximately by weight:

a) 1 to 50% of at least one nonsoap surfactant selected from the group consisting of betaine surfactant, nonionic surfactant and anionic surfactant and mixtures thereof, wherein said anionic detergent is selected from the group consisting of $C_{12}$–$C_{16}$ alkyl sulfates, $C_{10}$–$C_{15}$ alkylbenzene sulfonates, $C_{13}$–$C_{17}$ paraffin sulfonates and $C_{12}$–$C_{18}$ alpha olefin sulfonates and said nonionic surfactant is present in an amount of 1% to 25% by weight, said anionic detergent is present in an amount of 1% to 30% by weight and said betaine is present in an amount of 1% to 9% by weight;

b) 0.1% to 10 wt. % of a grease agent wherein the grease release agent consists of

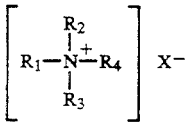

wherein $R_1$ is a methyl group and $R_2$, $R_3$ and $R_4$ are independently selected from the group consisting of $CH_3$, $C_2H_5$, $CH_2CH_2Y$, wherein Y is selected from the group consisting of Cl, Br, $CO_2H$, $(CH_2O)_nOH$, wherein n is 1 to 10, and OH and X is selected from the group consisting Cl, Br, methosulfate and $HCO_3$—;

c) 1 to 12% of a solubilizing agent selected from the group consisting of $C_2$–$C_3$ mono- and di-hydroxy alkanols, water soluble salts of $C_1$–$C_3$ substituted benzene sulfonate hydrotropes and mixtures thereof;

d) the balance being water.

17. A liquid detergent composition according to claim 16 wherein said anionic detergent is a $C_{12}$–$C_{16}$ alkyl sulfate.

18. A liquid detergent composition according to claim 16 further including a preservative.

19. A liquid detergent composition according to claim 16 further including a color stabilizer.

20. An all purpose hard surface cleaning composition according to claim 15 wherein at least one said surfactant is selected from the group consisting of anionic surfactants and nonionic surfactants and mixtures thereof.

21. An all purpose hard surface cleaning composition according to claim 20 wherein said cosurfactant is a monoalkyl ether or ester of ethylene glycol or propylene glycol.

22. An all purpose hard surface cleaning composition according to claim 21 wherein said magnesium containing inorganic compound is magnesium sulfate heptahydrate.

* * * * *